US009068751B2

(12) United States Patent
Snyder

(10) Patent No.: US 9,068,751 B2
(45) Date of Patent: Jun. 30, 2015

(54) GAS TURBINE COMBUSTOR WITH STAGED COMBUSTION

(75) Inventor: Timothy S. Snyder, Glastonbury, CT (US)

(73) Assignee: United Technologies Corporation, Hartford, CT (US)

( * ) Notice: Subject to any disclaimer, the term of this patent is extended or adjusted under 35 U.S.C. 154(b) by 1180 days.

(21) Appl. No.: 12/696,343

(22) Filed: Jan. 29, 2010

(65) Prior Publication Data

US 2011/0185735 A1 Aug. 4, 2011

(51) Int. Cl.
*F23R 3/50* (2006.01)
*F23R 3/34* (2006.01)

(52) U.S. Cl.
CPC .. *F23R 3/50* (2013.01); *F23R 3/346* (2013.01)

(58) Field of Classification Search
CPC ..... F23R 3/50; F23R 3/346
USPC ..... 60/746, 747, 749, 750, 752–760, 804
See application file for complete search history.

(56) References Cited

U.S. PATENT DOCUMENTS 4,030,875 A 6/1977 Grondahl et al.
4,104,874 A 8/1978 Caruel et al.
4,292,801 A * 10/1981 Wilkes et al. ..... 60/776
4,343,147 A * 8/1982 Shekleton ..... 60/776
5,220,795 A 6/1993 Dodds et al.
5,239,818 A * 8/1993 Stickles et al. ..... 60/804
5,402,634 A * 4/1995 Marshall ..... 60/776
5,435,139 A 7/1995 Pidcock et al.
5,469,700 A * 11/1995 Corbett et al. ..... 60/776
5,628,192 A 5/1997 Hayes-Bradley et al.
5,640,851 A 6/1997 Toon et al.
5,699,667 A * 12/1997 Joos ..... 60/737
5,758,503 A 6/1998 DuBell et al.
5,782,294 A 7/1998 Froemming et al.
5,791,148 A * 8/1998 Burrus ..... 60/752
5,797,267 A 8/1998 Richards
5,934,067 A 8/1999 Ansart et al.
5,983,642 A 11/1999 Parker et al.
6,047,539 A 4/2000 Farmer
6,070,412 A * 6/2000 Ansart et al. ..... 60/747
6,182,451 B1 2/2001 Hadder
6,189,814 B1 * 2/2001 Richards ..... 239/434
6,240,731 B1 6/2001 Hoke et al.
6,295,801 B1 * 10/2001 Burrus et al. ..... 60/776
6,370,863 B2 * 4/2002 Muller et al. ..... 60/776
6,378,286 B2 4/2002 Vermes et al.
6,470,685 B2 10/2002 Pidcock et al.
6,513,334 B2 * 2/2003 Varney ..... 60/776
6,571,566 B1 6/2003 Temple et al.
6,606,861 B2 8/2003 Snyder (Continued)

FOREIGN PATENT DOCUMENTS

EP 1288579 A1 * 3/2003
WO WO-2008127437 A2 10/2008

*Primary Examiner* — Ehud Gartenberg
*Assistant Examiner* — Karthik Subramanian
(74) *Attorney, Agent, or Firm* — Miller, Matthias & Hull LLP

(57) ABSTRACT

An annular combustor for a gas turbine engine is provided that facilitates staged combustion in a lean direct ignition (LDI) mode over an extended range of operating fuel air ratios. A method is also provided for operating a gas turbine engine over a power demand range that facilitates staged combustion in a lean direct ignition (LDI) mode over an extended range of operating fuel air ratios.

12 Claims, 4 Drawing Sheets

(56) References Cited

U.S. PATENT DOCUMENTS

| | | | | |
|---|---|---|---|---|
| 6,701,714 | B2 | 3/2004 | Burd et al. | |
| 6,735,949 | B1 * | 5/2004 | Haynes et al. | 60/746 |
| 6,763,664 | B2 | 7/2004 | Aoyama | |
| 6,810,673 | B2 | 11/2004 | Snyder | |
| 6,923,001 | B2 * | 8/2005 | Laster et al. | 60/723 |
| 6,945,053 | B2 * | 9/2005 | Von Der Bank | 60/776 |
| 6,951,108 | B2 * | 10/2005 | Burrus et al. | 60/746 |
| 6,962,055 | B2 * | 11/2005 | Chen et al. | 60/746 |
| 6,968,699 | B2 * | 11/2005 | Howell et al. | 60/776 |
| 7,024,862 | B2 * | 4/2006 | Miyake et al. | 60/773 |
| 7,093,439 | B2 | 8/2006 | Pacheco-Tougas et al. | |
| 7,093,441 | B2 * | 8/2006 | Burd et al. | 60/752 |
| 7,484,352 | B2 * | 2/2009 | Flohr et al. | 60/39.281 |
| 7,506,511 | B2 * | 3/2009 | Zupanc et al. | 60/746 |
| 2002/0116929 | A1 | 8/2002 | Snyder | |
| 2002/0189260 | A1 * | 12/2002 | David et al. | 60/746 |
| 2003/0061817 | A1 | 4/2003 | Aoyama | |
| 2003/0101731 | A1 | 6/2003 | Burd et al. | |
| 2003/0167771 | A1 | 9/2003 | Hayashi et al. | |
| 2003/0213250 | A1 | 11/2003 | Pacheco-Tougas et al. | |
| 2003/0233832 | A1 | 12/2003 | Martling et al. | |
| 2004/0006995 | A1 | 1/2004 | Snyder | |
| 2004/0226299 | A1 | 11/2004 | Drnevich | |
| 2004/0231333 | A1 | 11/2004 | Tiemann | |
| 2004/0255594 | A1 * | 12/2004 | Baino et al. | 60/773 |
| 2005/0022531 | A1 | 2/2005 | Burd | |
| 2005/0086940 | A1 | 4/2005 | Coughlan et al. | |
| 2005/0086944 | A1 | 4/2005 | Cowan | |

* cited by examiner

GAS TURBINE COMBUSTOR WITH STAGED COMBUSTION

FIELD OF THE INVENTION

This invention relates generally to gas turbine engines and, more particularly, to an annular combustor for and a method for operating a gas turbine engine in a staged combustion mode.

BACKGROUND OF THE INVENTION

Gas turbine engines, such as those used to power modern commercial aircraft or in industrial applications, include a compressor for pressurizing a supply of air, a combustor for burning a hydrocarbon fuel in the presence of the pressurized air, and a turbine for extracting energy from the resultant combustion gases. Generally, the compressor, combustor and turbine are disposed about a central engine axis with the compressor disposed axially upstream of the combustor and the turbine disposed axially downstream of the combustor.

An exemplary combustor features an annular combustion chamber defined between a radially inboard liner and a radially outboard liner extending aft from a forward bulkhead. The radially outboard liner extends circumferentially about and is radially spaced from the inboard liner, with the combustion chamber extending fore to aft therebetween. Exemplary liners are double structured, having an inner heat shield and an outer shell. Arrays of circumferentially distributed combustion air holes penetrate the outboard liner and the inboard liner at one or more axial locations to admit combustion air into the combustion chamber along the length of the combustion chamber. A plurality of circumferentially distributed fuel injectors and associated swirlers or air passages is mounted in the forward bulkhead. The fuel injectors project into the forward end of the annular combustion chamber to supply the fuel to be combusted. The swirlers impart a swirl to inlet air entering the forward end of the combustion chamber at the bulkhead to provide rapid mixing of the fuel and inlet air. Commonly assigned U.S. Pat. Nos. 7,093,441; 6,606,861 and 6,810,673, the entire disclosures of which are hereby incorporated herein by reference as if set forth herein, disclose exemplary prior art annular combustors for gas turbine engines.

Combustion of the hydrocarbon fuel in air inevitably produces oxides of nitrogen (NOx). NOx emissions are the subject of increasingly stringent controls by regulatory authorities. Accordingly, engine manufacturers strive to minimize NOx emissions. One combustion strategy for minimizing NOx emissions from gas turbine engines is commonly referred to as lean direct injection (LDI) combustion. The LDI combustion strategy recognizes that the conditions for NOx formation are most favorable at elevated combustion flame temperatures, i.e. when the fuel-air ratio is at or near stoichiometric.

In LDI combustion, more than the stoichiometric amount of air is required to minimize flame temperature whereas the rich-lean combustors drive a rich front end to lean conditions to minimize high stoichiometric flame temperatures. The combustion process in a combustor configured for LDI combustion, by design intent, exists in one bulk governing state in which combustion is exclusively stoichiometricly fuel lean. Clearly, local conditions may not be lean given that mixing of the fuel and air require some finite time and spatial volume via mixing to achieve this state. However, overall combustion occurs under fuel lean conditions, that is at an equivalence ratio less than 1.0. The substantial excess of air in the forward combustion zone inhibits NOx formation by suppressing the combustion flame temperature.

In gas turbine operations, the overall combustion fuel air ratio is determined by the power demand on the engine. At low power demand, the combustor is fired at a relatively low fuel air ratio. At high power demand, the combustor is fired at a relatively high fuel air ratio. Under both low power demand and high power demand operation, the fuel air ratio remains overall fuel lean. The capability of operating gas turbine engines having conventional combustors with LDI combustion has proved to be somewhat limited at low fuel air ratios due to reduced combustion efficiency and fuel lean combustion stability concerns.

SUMMARY OF THE INVENTION

An annular combustor for a gas turbine engine is provided that facilitates staged combustion in a lean direct ignition (LDI) mode over an extended range of operating fuel air ratios. A method is also provided for operating a gas turbine engine over a power demand range that facilitates staged combustion in a lean direct ignition (LDI) mode over an extended range of operating fuel air ratios.

In an aspect, an annular combustor for a gas turbine engine includes an inboard liner extending circumferentially and extending longitudinally fore to aft, an outboard liner extending circumferentially and extending longitudinally fore to aft and circumscribing the inboard liner, a bulkhead extending between a forward end of the inboard liner and a forward end of the outboard liner and in cooperation with the inboard liner and the outboard liner defining the annular combustion chamber, a plurality of primary fuel injectors opening through the bulkhead for admitting fuel into the annular combustion chamber and a plurality of secondary fuel injectors. The plurality of the primary fuel injectors are disposed at circumferentially spaced intervals in a ring radially intermediate the inboard liner and the outboard liner. The plurality of secondary fuel injectors are disposed at circumferentially spaced intervals in a ring radially outboard of the plurality of primary fuel injectors. The plurality of secondary fuel injectors may be arranged in circumferential alignment with the plurality of primary fuel injectors. In an embodiment, the annular combustor may include a plurality of tertiary fuel injectors opening through the bulkhead, the plurality of tertiary fuel injectors disposed at circumferentially spaced intervals and arranged in alternating relationship with the plurality of primary fuel injectors. In an embodiment, the plurality of tertiary fuel injectors include a plurality of tertiary fuel injectors disposed at circumferentially spaced intervals in a ring radially outboard of the plurality of primary fuel injectors and arranged in alternating relationship with the plurality of primary fuel injectors. In an embodiment, the plurality of tertiary fuel injectors includes a first plurality of tertiary fuel injectors disposed at circumferentially spaced intervals in a ring radially outboard of the plurality of primary fuel injectors and arranged in alternating relationship with the plurality of primary fuel injectors, and a second plurality of tertiary fuel injectors disposed at circumferentially spaced intervals in a ring radially inboard of the plurality of primary fuel injectors and arranged in alternating relationship with the plurality of primary fuel injectors. The plurality of tertiary fuel injectors may be a plurality of fuel injectors for injecting a fuel lean premixture of fuel and air.

In an aspect, an annular combustor for a gas turbine engine includes an inboard liner extending circumferentially and extending longitudinally fore to aft, an outboard liner extending circumferentially and extending longitudinally fore to aft and circumscribing the inboard liner, and a bulkhead extending between a forward end of the inboard liner and a forward end of the outboard liner and in cooperation with the inboard liner and the outboard liner defining an annular combustion chamber. The outboard liner including a forward section defining a radially outward projecting chamber extending aftward from the bulkhead and circumferentially about and in open relationship to the annular combustion chamber. In an embodiment, the inboard liner also includes a forward section defining a radially inward projecting secondary chamber extending aftward from the bulkhead and circumferentially about and in open relationship to the annular combustion chamber. In an embodiment, a plurality of primary fuel injectors open through the bulkhead for admitting fuel into the annular combustion chamber and a plurality of secondary fuel injectors opening through the bulkhead for admitting fuel into the radially outwardly projecting chamber defined within the forward section of the outboard liner. In an embodiment, the annular combustor further includes a first plurality of tertiary fuel injectors opening through the bulkhead radially outboard of the plurality of primary fuel injectors for admitting fuel into the annular combustion chamber and a second plurality of tertiary fuel injectors opening through the bulkhead radially inboard of the primary fuel injectors for admitting fuel into the annular combustion chamber.

In an aspect, a method is provided for operating a gas turbine engine over a power demand range having a low power demand, an intermediate power demand and a maximum power demand, the gas turbine engine having an inboard liner, an outboard liner circumscribing the inboard liner, and a bulkhead extending between a forward end of the inboard liner and a forward end of the outboard liner and in cooperation with the inboard liner and the outboard liner defining an annular combustion chamber. The method includes the steps of: providing a stabilization chamber radially outboard of and circumscribing the annular combustion chamber in open relationship to the annular combustion chamber; injecting a primary fuel supply into the annular combustion chamber; and injecting a secondary fuel supply into the stabilization chamber. The method may further include the step of injecting a first tertiary fuel supply in the annular combustion chamber when operating the gas turbine engine in the intermediate power demand and when operating the gas turbine engine in the maximum power demand. The method may further include the step of injecting a second tertiary fuel supply into the annular combustion chamber when operating the gas turbine engine in the maximum power demand.

BRIEF DESCRIPTION OF THE DRAWINGS

For a further understanding of the disclosure, reference will be made to the following detailed description which is to be read in connection with the accompanying drawing, where.

DETAILED DESCRIPTION OF THE INVENTION

Figure 1:
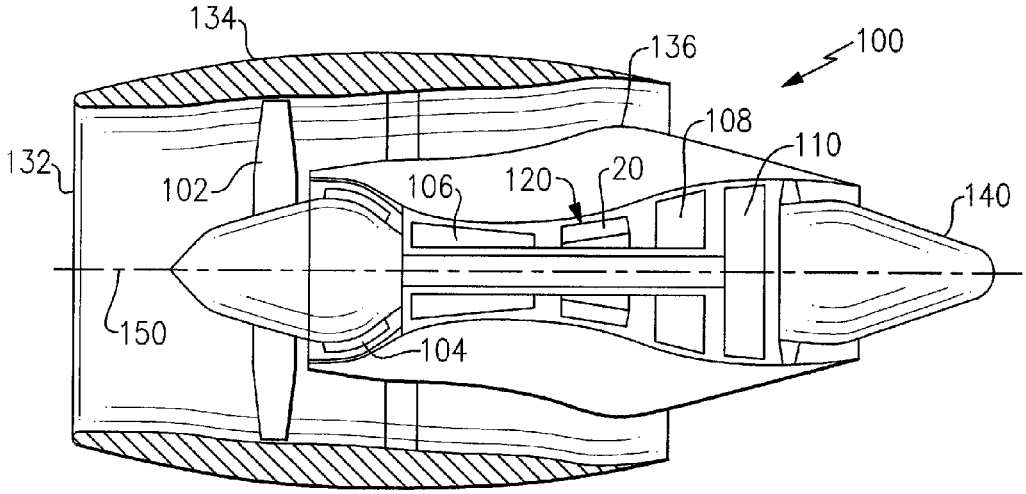
FIG. 1 is a schematic view of a longitudinal section of an exemplary embodiment of a turbofan gas turbine engine.

Referring now in FIG. 1, there is shown an exemplary embodiment of a turbofan gas turbine engine, designated generally as 100, that includes a turbine having rotating blades that could be repaired when the tips thereof are eroded by use of the method for repairing a turbine blade as disclosed herein. The turbofan gas turbine engine 100 includes, from fore-to-aft longitudinally about a central engine axis 150, a fan 102, a low pressure compressor 104, a high pressure compressor 106, a combustor module 120, a high pressure turbine 108, and a low pressure turbine 110. A nacelle forms a housing or wrap that surrounds the gas turbine engine 100 to provide an aerodynamic housing about gas turbine engine. In the turbofan gas turbine engine 100 depicted in the drawings, the nacelle includes, from fore to aft, the engine inlet 132, the fan cowl 134, the engine core cowl 136 and the primary exhaust nozzle 140. It is to be understood that the annular combustor 120 as disclosed herein is not limited in application to the depicted embodiment of a gas turbine engine, but is applicable to other types of gas turbine engines, including other types of aircraft gas turbine engines, as well as industrial and power generation gas turbine engines.

Figure 4:
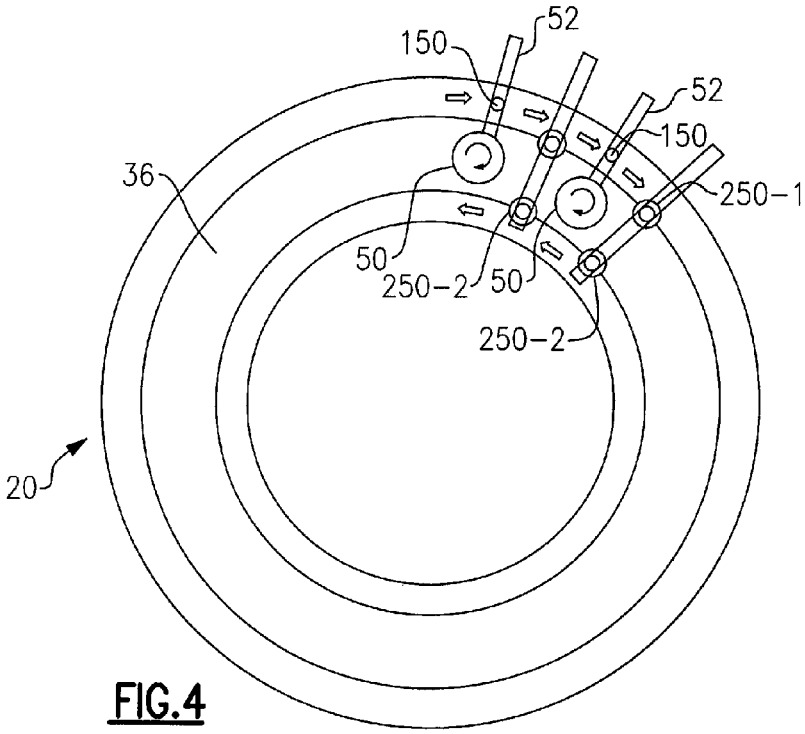
FIG. 4 is an elevation view of the annular combustor of FIG. 2 from within the combustion chamber looking forward.
Figure 2:
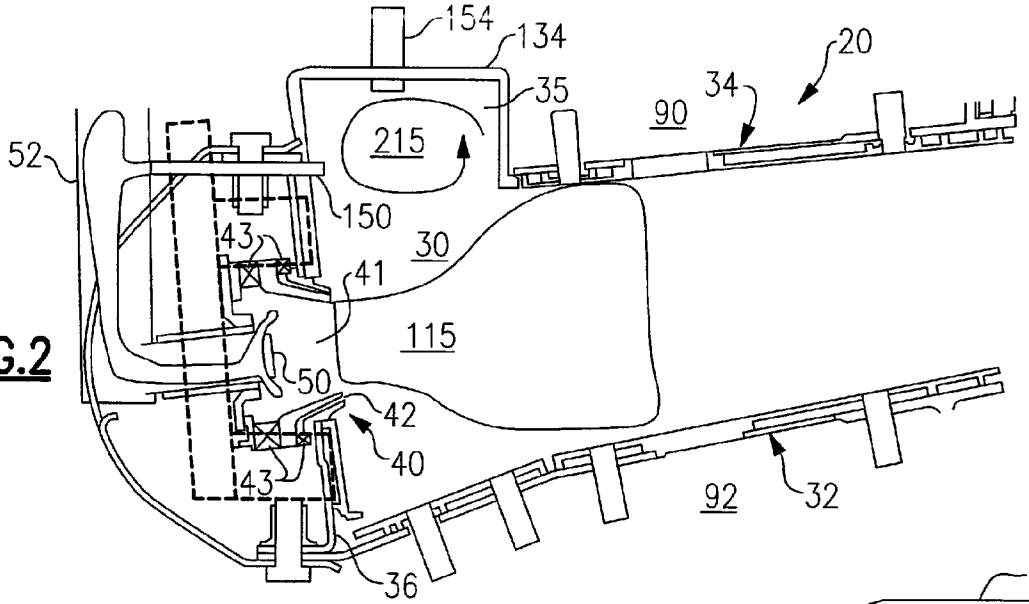
FIG. 2 is a sectioned side elevation view of an exemplary annular combustor according to an aspect of the present invention illustrated as operating in a low power demand mode.
Figure 3:
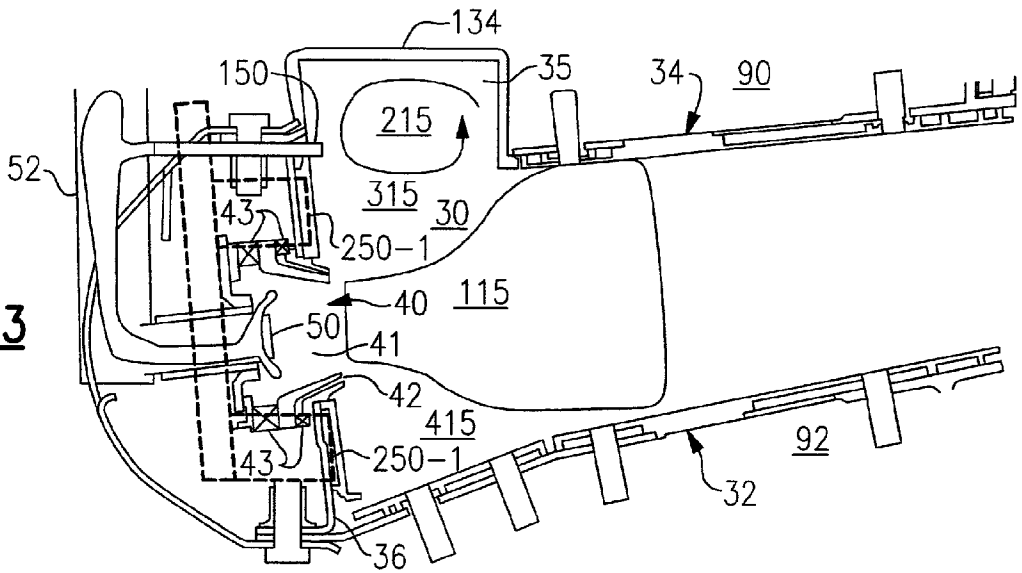
FIG. 3 is a sectioned side elevation view of the exemplary annular combustor of FIG. 2 illustrated as operating in a high power demand mode.
Figure 5:
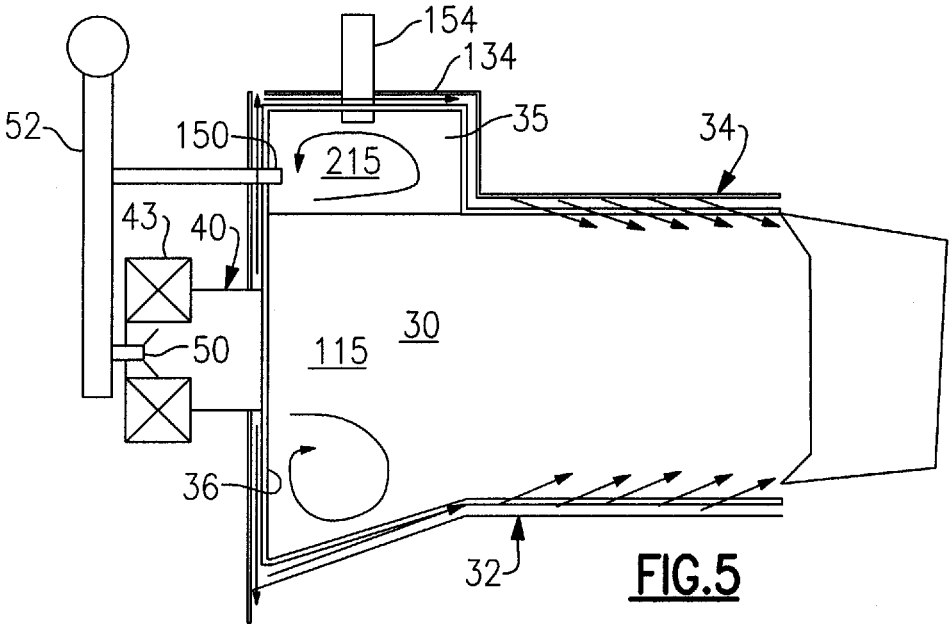
FIG. 5 is a sectioned side elevation view of another exemplary annular combustor according to an aspect of the present invention illustrating fuel delivery to the combustion chamber in all demand modes.
Figure 6:
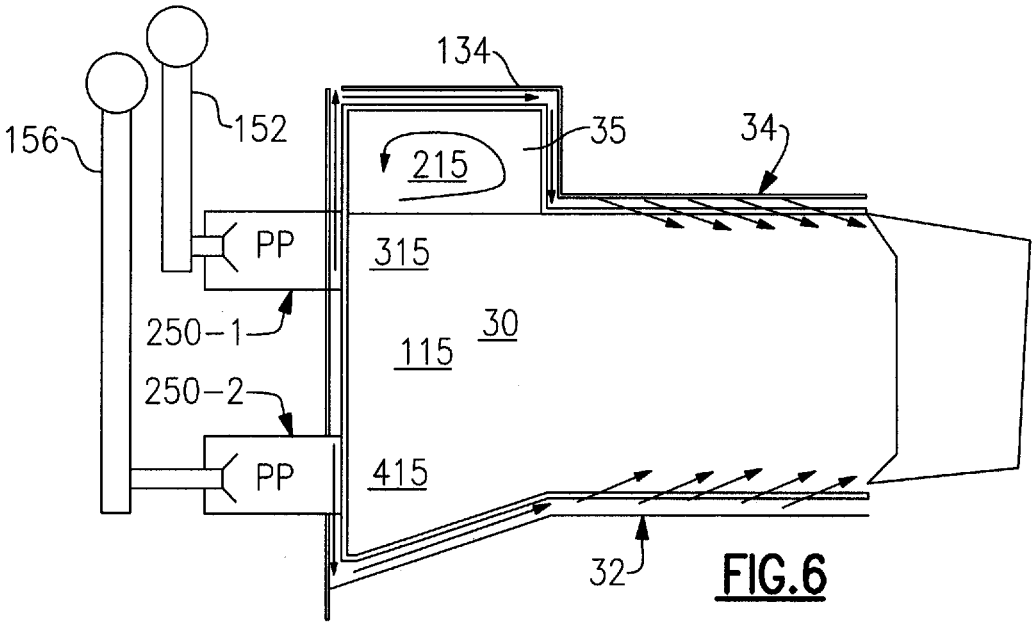
FIG. 6 is a sectioned side elevation view of the exemplary annular combustor of FIG. 5 illustrating additional fuel delivery to the combustion chamber primarily in a mid to a high power demand mode.

Referring now to FIGS. 2-4, the combustor module 120 includes an annular combustor 20 which is disposed about the engine axis 150 in an annular pressure vessel (not shown) defined by a radially inner case (not shown) and a radially outer case (not shown). The annular combustor 20 includes a radially inboard liner 32, a radially outboard liner 34 that circumscribes the inboard liner 32, and a forward bulkhead 36. The bulkhead 36 extends between the respective forward end of the inboard liner 32 and the forward end of the outboard liner 34. The inboard liner 32 and the outboard liner 34 extend longitudinally fore-to-aft from the forward bulkhead 36 to the combustor exit. Collectively, the inboard liner 32, the outboard liner 34 and the forward bulkhead 36 bound the annular combustion chamber 30.

Referring now also to FIG. 4 in particular, the forward bulkhead 36 carries a plurality of air swirlers 40, for example typically from 12 to 24 depending upon the size of the engine, disposed in a circumferential array at spaced intervals about the annular combustion chamber 30. Each air swirler 40 is disposed at the end of a primary fuel injector 50 which is in flow communication with a fuel supply tube 52 that extends through the outer case (not shown) to convey fuel from an external source to the associated fuel injector 50. Each fuel injector 50 includes a spray head through which fuel is sprayed into a stream of air emitted along the centerline of the fuel nozzle. The air swirler 40 may have multiple air passages 41, 42 with multiple inlet passages 43.

In operation, pressurized air from the compressor is decelerated as it passes through a diffuser section connecting the outlet of the high pressure compressor 106 and is directed into the annular plenums 90, 92 defined within the annular pressure vessel (not shown), the annular plenum 90 extending circumferentially along and radially inwardly of the inboard liner 32 and the annular plenum 92 extending circumferentially about and radially outwardly of the outboard liner 34. A portion of this pressured air passes into the combustion chamber through the air inlet passages 43 that impart a spin to the air passing therethrough to provide rapid mixing of this air with the fuel being injected through the associated fuel injector 50 to promote initial combustion of the fuel in a fuel-lean state in a forward portion of the combustion chamber, for example, in the region 115 in FIGS. 2 and 3.

In the annular combustor 20, the outboard liner 34 includes a forward section 134 that projects generally radially outwardly at the forward end of the outboard liner 34 and extends aftward from the forward bulkhead 36. The forward section 134 forms part of the outboard liner 34 and defines a radially outwardly projecting chamber 35 that extends aftward from the bulkhead 36 and circumferentially radially outwardly about and in open relationship to the annular combustion chamber of the annular combustor 20. A plurality of secondary fuel injectors 152 are provided for delivering additional fuel to the combustor 20. The plurality of secondary fuel injectors are disposed at circumferentially spaced intervals in a ring radially outboard of the plurality of primary fuel injectors 50. In the embodiments depicted in the drawings, one secondary fuel injector 152 may be provided in operative association with each primary fuel injector 50. As illustrated in FIG. 4, the number of secondary fuel injectors 152 may be equal to the number of primary fuel injectors and the secondary fuel injectors 152 are arranged at circumferentially spaced intervals in a ring radially outboard of the ring of primary fuel injectors 50. In the depicted embodiment, each secondary fuel injector 152 is also arranged in circumferential alignment with an associated primary fuel injector 50.

Each secondary fuel injector 152 opens at one end through the wall of the forward section 134 into the chamber 35 and at its other end taps into, that is connects in flow communication with, the fuel supply tube 52. As will be explained in further detail hereinafter, in operation of the gas turbine engine, a portion of the fuel flowing through each fuel supply tube 52 passes through the respective secondary fuel injector 152 that taps into that fuel supply tube 52 and is thereby directed into the chamber 35 rather than into the main annular combustion chamber 30. One or more igniters 154 are provided for igniting the fuel delivered to the chamber 35.

Figure 7:
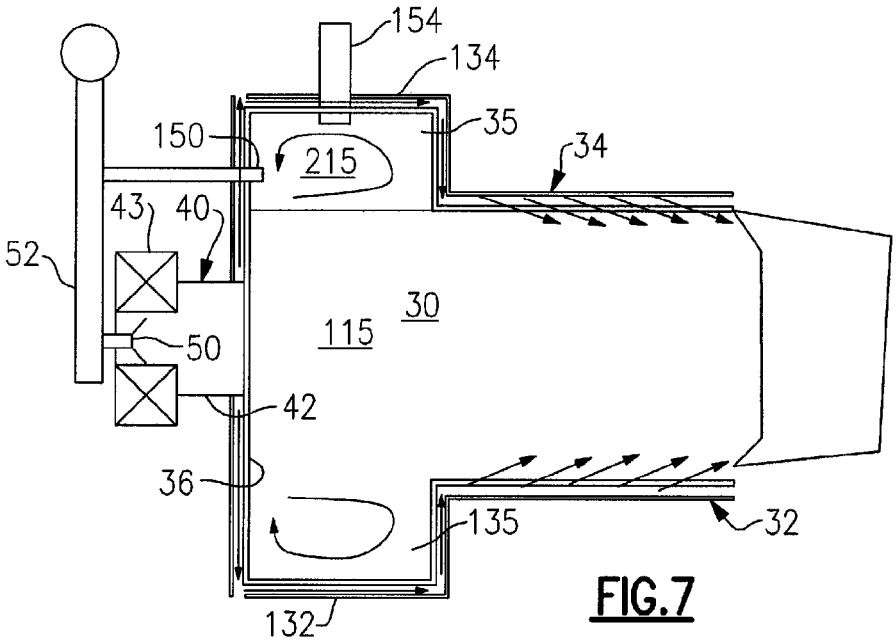
FIG. 7 is a sectioned side elevation view of another exemplary annular combustor according to an aspect of the present invention illustrating fuel delivery to the combustion chamber in all demand modes.
Figure 8:
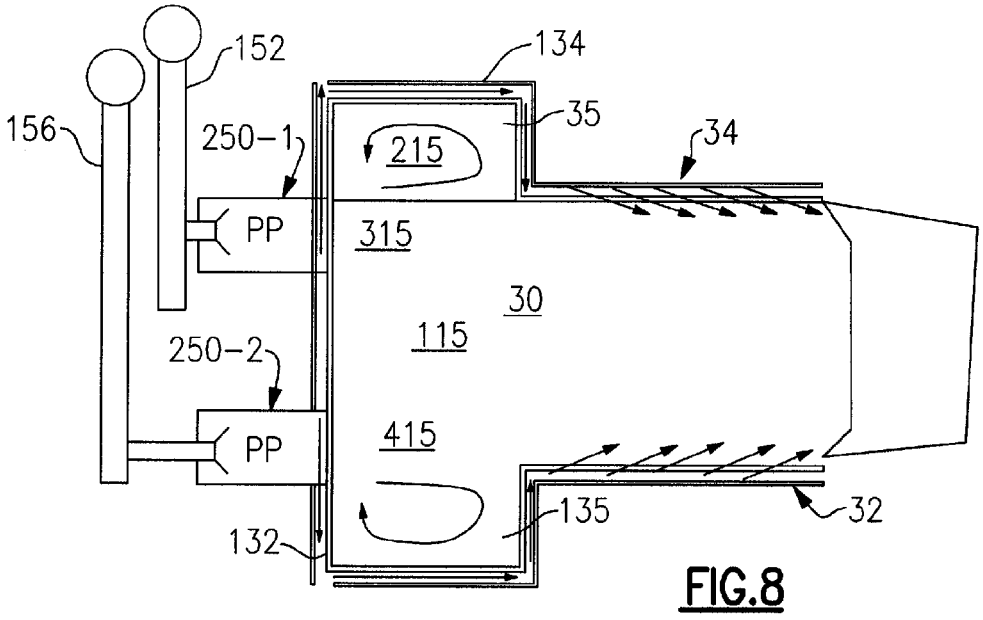
FIG. 8 is a sectioned side elevation view of the exemplary annular combustor of FIG. 7 illustrating additional fuel delivery to the combustion chamber primarily in a mid to a high power demand mode.

As will be discussed in further detail hereinafter, the radially outwardly projecting chamber 35 at the forward end of the outboard liner 34 functions both as a combustion stabilization chamber and also as an ignition chamber. In the embodiments of the annular combustor 20 depicted in FIGS. 2, 3, 5 and 6, a radially outwardly projecting combustion chamber 35 is provided in the outboard liner 34 only. There is no corresponding chamber provided in the inboard liner 32. However, in the embodiment of the annular combustor 20 depicted in FIGS. 7 and 8, a radially inwardly projecting combustion chamber 135 is provided in the inboard liner 32 in addition to the radially outwardly projecting combustion chamber 35. As depicted in FIGS. 7 and 8, the inboard liner 32 includes a forward section 132 that projects generally radially inwardly at the forward end of the inboard liner 32 and extends aftward from the forward bulkhead 36. The forward section 132 forms part of the outboard liner 34 and defines the radially inwardly projecting chamber 135 that extends aftward from the bulkhead 36 and circumferentially radially inwardly about and in open relationship to the annular combustion chamber of the annular combustor 20. Unlike the chamber 35, the chamber 135 no fuel is delivered directly into the chamber 135 and no igniter is operative associated with the chamber 135. However, although the radially inwardly projecting chamber 135 does not function as an ignition chamber, the radially inwardly projecting chamber 135, like its counterpart radially outwardly projecting chamber 35 in the outboard liner 34, does function as a combustion stabilization chamber.

In addition to the primary fuel injectors 50 and the secondary fuel injectors 150, the annular combustor 20 includes a plurality of tertiary fuel injectors 250-1, 250-2 opening through the forward bulkhead 36. The plurality of tertiary fuel injectors 250-1, 250-2 are disposed at circumferentially spaced intervals and arranged in alternating relationship with the plurality of primary fuel injectors 50. The plurality of tertiary fuel injectors may include a first plurality of tertiary fuel injectors 250-1 disposed in a ring located radially outboard of the ring of primary fuel injectors 50 and a second plurality of tertiary fuel injectors 250-2 disposed in a ring located radially inward of the ring of primary fuel injectors 50. Each of the first plurality of tertiary fuel injectors 250-1 opens at one end through the forward bulkhead 36 into the annular combustion chamber and at its other end taps into a tertiary fuel supply tube 152. Each of the second plurality of tertiary fuel injectors 250-2 opens at one end through the forward bulkhead 36 into the annular combustion chamber and at its other end taps into a tertiary fuel supply tube 156. The first and second plurality of tertiary fuel injectors 250-1, 250-2 may be arranged in a plurality of paired sets disposed at circumferentially spaced intervals in radially spaced rings, as illustrated in FIG. 4, with the first tertiary fuel injector 250-1 of each set disposed in a ring radially outboard of the ring of primary fuel injectors 50 and the second tertiary fuel injector 250-2 of each set disposed in a ring radially inboard of the ring of primary fuel injectors 50.

The annular combustor 20 disclosed herein facilitates operating a gas turbine engine over a range of power demand in accord with the method disclosed herein using staged combustion. For example, aircraft gas turbine engines should be capable of operating over a wide power demand range while maintaining combustion efficiency and limiting smoke and NOx emissions. In aircraft applications, power demand on the engine is low during landing and ground taxiing, is intermediate when at cruise, and is high during take-off and climb. In gas turbine engines, the amount of fuel delivered to the combustor is directly proportional to the power demand on the engine. In combustors operating in a lean-direct ignition (LDI) mode, the overall combustor fuel/air ratio also varies as a function of power demand from a very fuel lean mixture at low power demand to a near stoichiometric fuel air ratio at high power demand.

In the method for operating a gas turbine engine as disclose herein delivery of fuel to the combustor 20 is staged over power demand through selectively distributing fuel amongst the primary fuel injectors 50, the secondary fuel injectors 150 and the tertiary fuel injectors 250-1, 250-2. In an embodiment, the method includes the steps of: injecting a primary fuel supply into a central primary combustion zone of the annular combustion chamber at all load demands, injecting a secondary fuel supply into a secondary combustion zone radially outboard of the central primary combustion zone at all load demands; injecting a first tertiary fuel supply into a first tertiary combustion zone radially outboard of the primary combustion zone and radially inboard of the secondary combustion zone at intermediate to high power demands, and injecting a second tertiary fuel supply into a second tertiary combustion zone radially inboard of the primary combustion zone at high power demands.

For example, referring now to FIG. 2 in particular, at low power demand, fuel is delivered from fuel supply tube 52 to each of the plurality of primary fuel injectors 50 and each of the plurality of secondary fuel injectors 150, while no fuel is delivered to the combustor 20 through the tertiary fuel injectors 250-1, 250-2. The fuel delivered to the primary fuel injectors 50 is injected into a central primary combustion zone 115 extending aftwardly as a ring of flame in the annulus of the annular combustion chamber. The fuel delivered to the secondary fuel injectors 150 is injected into a secondary combustion zone 215 within the chamber 35 defined within the radially outwardly projecting portion 134 of the outboard liner 34. The secondary combustion zone 215 extends circumferentially around and radially outboard of the forward region of the primary combustion zone 115. The fuel injected into the chamber 35 is ignited in the secondary combustion zone 215. Because the secondary combustion zone 215 is confined, radially outwardly and axially, within the chamber 35, a trapped vortex flow dominates within the secondary combustion zone 215. The presence of the trapped vortex flow enhances ignition and combustion stability. Ignition of the fuel delivered to the primary combustion zone 115 may be initiated simply by ignition migration from the secondary combustion zone 215 or may be initiated through additional igniters (not shown) operatively associated directly with the primary fuel injectors 50.

Referring now to FIG. 3 in particular, at high power, in addition to fuel being delivered to the primary fuel injectors 50 and the secondary fuel injectors 150 as described in above, fuel is also delivered to both sets of the tertiary fuel injectors 250-1, 250-2 through the tertiary fuel supply tube 152. The fuel delivered to the first plurality of tertiary fuel injectors 250-1 is injected in a first tertiary combustion zone 315 and the fuel delivered to the second plurality of tertiary fuel injectors is injected into a second tertiary combustion zone 415. The first tertiary combustion zone 315 extends circumferentially along the primary combustion zone 115 and lies radially outboard of the primary combustion zone 115 and radially inboard of the combustion zone 215. The second tertiary combustion zone 415 also extends circumferentially along the primary combustion zone 115, but lies radially inboard of the primary combustion zone 115.

As noted previously, at low power demand, fuel is delivered to the primary fuel injectors 50 and to the plurality of secondary fuel injectors 150, but not to either the first plurality of tertiary fuel injectors 250-1 or the second plurality of tertiary fuel injectors 250-2. At intermediate or mid power demand, fuel is supplied to as described in the preceding paragraphs to the plurality of primary fuel injectors 50, the plurality of secondary fuel injectors 150, and the first plurality of tertiary fuel injectors 250-1, but fuel is not supplied through the second plurality of tertiary fuel injectors 250-2. At high power demand, fuel is supplied to as described in the preceding paragraphs to the plurality of primary fuel injectors 50, the plurality of secondary fuel injectors 150, and both the first plurality of tertiary fuel injectors 250-1 and the second plurality of tertiary fuel injectors 250-2.

It is to be noted that mixing of the combusting fuel and air within the annular combustion chamber is improved by the interaction of the combustion gases at the interfaces of the various zones. For example, in the depicted embodiment as illustrated in FIG. 4, the air associated with the primary fuel injectors 50 is swirled in a clockwise direction as it enters into the central primary combustion zone 115. As a result, the interaction of the combustion gases at the interface of the first tertiary combustion zone 315 and the primary combustion zone 115 generates a generally clockwise flow of the combustion gases in the first tertiary zone 315 about the primary combustion zone 115. At the same time, the interaction of the combustion gases at the interface of the second tertiary combustion zone 415 and the primary combustion zone 115 generates a generally counter-clockwise flow of the combustion gases in the second tertiary zone 415 about the primary combustion zone 115.

In an aspect of the method disclosed herein, at low power demand, the method includes the steps of combusting the primary fuel supply in the primary combustion zone 115 under fuel lean conditions, that is at an equivalence ratio of less than 1.0 and combusting the secondary fuel supply in the second combustion zone 215 within the stabilization chamber 35 at near stoichiometric conditions, that is at an equivalence ratio of about 1.0. However, at high power, the method includes the steps of combusting the primary fuel supply in the primary combustion zone 115 under fuel lean conditions and also combusting the secondary fuel supply in the second combustion zone 215 within the stabilization chamber 35 under fuel lean conditions, that is at an equivalence ratio less than 1.0. Additionally, fuel injected through the tertiary fuel injectors 250-1, 250-2 may be injected as partially premixed fuel and air whereby combustion within the first and second tertiary combustion zones will always occur under fuel lean conditions. In this manner, the secondary combustion zone 215 within the chamber 35 serves as a stabilization zone at low power demand, due to the trapped vortex flow and the near stoichiometric fuel air ratio within the secondary combustion zone, while at high power, fuel lean fuel air ratios are maintained throughout the combustion chamber thereby promoting lower NOx emissions.

In an embodiment, for example, at low power demand, the method includes the steps of combusting the primary fuel supply in a fuel-lean primary combustion zone 115 and combusting the secondary fuel supply in the second combustion zone 215 within the stabilization chamber 35 at an equivalence ratio of about 1.0. However, at high power, the method includes the steps of combusting the primary fuel supply in a fuel-lean primary combustion zone 115, combusting the secondary fuel supply in a fuel-lean second combustion zone 215 within the stabilization chamber 35, and combusting the tertiary fuel supply in part in a fuel-lean first tertiary combustion zone 315 and in part in a fuel-lean second tertiary combustion zone 415.

The establishment of a secondary combustion zone 215 radially outboard of and circumscribing the forward region of the primary combustion 115 in accord with the method and the annular combustor disclosed herein provides for continuous combustion stabilization over the entire power demand range. Additionally, the establishment at high power demand of a first tertiary combustion zone 315 radially outboard of the primary combustion zone 115 and radially inboard of the secondary combustion zone 215 and of a second tertiary combustion zone 415 radially inboard of the primary combustion zone 115 ensures a more uniform radial exit temperature profile in the combustion gases passing from the annular combustion chamber through the exit guide vanes into the turbine, in comparison to the combustor exit temperature profiles characteristic of conventional annular combustors wherein the fuel is delivered to the annular combustion chamber through a single ring of primary fuel injectors.

The forward portion 134 of the outboard liner 34 defining the radially outwardly projecting chamber 35 and the forward portion 132 of the inboard liner 32 defining the radially inwardly projecting chamber 135 may be of a double wall construction having an inner wall of ceramic or other material having a high heat resistance and an outer wall of metal or other structural supporting material with the outer wall spaced from the inner wall thereby providing cooling gap therebetween. Cooling air may be passed through the cooling gap to provide for convective cooling of both the inner wall and the outer wall.

In the exemplary embodiments depicted, the remaining portion of the outboard liner 34 and, depending upon the embodiment, all or the remaining portion of the inboard liner 32 may be of a double-wall construction and effusion cooled. More specifically, with the exception of the forward sections 132, 134, the inboard liner 32 and the outboard liner 34 may be structured with a support shell and one or more associated heat shields secured to the support shell. The heat shields may be formed as a circumferential array of panels, each panel having a longitudinal expanse in the axial direction and a lateral expanse in the circumferential direction and a surface that faces the hot combustion products within the combustion chamber.

The support shell and heat shields of each of the inboard liner 32 and the outboard liner 34 may be perforated with a plurality of relatively small diameter cooling air holes through which pressurized air passes from the plenums 92, 94 into the annular combustion chamber. The cooling holes may be angled downstream whereby the effusion cooling air not only cools the shell and heat shields of each of the inboard liner 32 and the outboard liner 34 as it passes through the heat shield, but also flows along the surface of the heat shield panels facing the combustion chamber thereby providing a protective cooling air layer along that surface. The effusion cooling air also gradually mixes into the combustion gases passing through the downstream portion of the combustion chamber thereby assisting in shaping the exit temperature profile of the combustion gases leaving the combustor exit to pass through the exit guide vanes and into the turbine. Exemplary liner and heat shield constructions are described and shown in commonly assigned U.S. Pat. No. 7,093,439, the entire disclosure of which is hereby incorporated herein by reference as if set forth herein. Other embodiments, including single-wall liners, are still within the spirit and scope of the invention.

While the present invention has been particularly shown and described with reference to the exemplary embodiments as illustrated in the drawing, it will be recognized by those skilled in the art that various modifications may be made without departing from the spirit and scope of the invention. For example, while the secondary combustion zone 215 is operated at or near stoichiometric conditions at low power demand, at mid to high power demand the secondary combustion zone 215 could be operated under fuel-lean conditions for controlling emissions or under fuel-rich conditions for controlling combustion dynamics.

The terminology used herein is for the purpose of description, not limitation. Specific structural and functional details disclosed herein are not to be interpreted as limiting, but merely as basis for teaching one skilled in the art to employ the present invention. Those skilled in the art will also recognize the equivalents that may be substituted for elements described with reference to the exemplary embodiments disclosed herein without departing from the scope of the present invention.

Therefore, it is intended that the present disclosure not be limited to the particular embodiment(s) disclosed as, but that the disclosure will include all embodiments falling within the scope of the appended claims.

I claim:

1. An annular combustor for a gas turbine engine, comprising:

an inboard liner extending circumferentially and extending longitudinally fore to aft;

an outboard liner extending circumferentially and extending longitudinally fore to aft and circumscribing the inboard liner;

a bulkhead extending between a forward end of the inboard liner and a forward end of the outboard liner and in cooperation with the inboard liner and the outboard liner defining the annular combustion chamber;

the outboard liner including a forward section defining a radially outward projecting substantially rectangular stabilization chamber extending aftward from the bulkhead and circumferentially about and in open relationship to the annular combustion chamber;

the inboard liner including a forward section and an aft section, the forward section converges towards the outboard liner from fore to aft and the aft section converges towards the outboard liner from fore to aft more gradually than the forward section;

a plurality of primary fuel injectors opening through the bulkhead admitting fuel directly into a central primary combustion zone of the annular combustion chamber, the plurality of the primary fuel injectors disposed at circumferentially spaced intervals in a ring radially intermediate the inboard liner and the outboard liner;

a plurality of secondary fuel injectors opening through the bulkhead admitting fuel directly into a secondary combustion zone substantially located in the stabilization chamber of the outboard liner, the plurality of secondary fuel injectors being independently controllable relative to the plurality of primary fuel injectors, disposed at circumferentially spaced intervals in a ring coaxially radially outboard of the plurality of primary fuel injectors and arranged in circumferential alignment with the plurality of primary fuel injectors;

a first plurality of tertiary fuel injectors opening through the bulkhead admitting fuel directly into a first tertiary combustion zone, the first plurality of tertiary fuel injectors being independently controllable relative to the plurality of primary fuel injectors and plurality of secondary fuel injectors, disposed at circumferentially spaced intervals in a ring coaxially radially outboard of the plurality of primary fuel injectors and coaxially radially inboard of the plurality of secondary fuel injectors, and arranged in an alternating relationship with the plurality of primary fuel injectors and plurality of secondary fuel injectors, the first tertiary combustion zone located coaxially radially outboard of the central primary combustion zone and coaxially radially inboard of the secondary combustion zone; and a second plurality of tertiary fuel injectors opening through the bulkhead admitting fuel into a second tertiary combustion zone of the annular combustion chamber, the second plurality of tertiary fuel injectors being independently controllable relative to the plurality of primary fuel injectors, plurality of secondary fuel injectors and first plurality of tertiary fuel injectors, disposed at circumferentially spaced intervals in a ring coaxially radially inboard of the plurality of primary fuel injectors, and arranged in an alternating relationship with the plurality of primary fuel injectors and plurality of secondary fuel injectors, the second tertiary combustion zone located radially inward of the central primary combustion zone.

2. The annular combustor as recited in claim 1 wherein the first plurality of tertiary fuel injectors comprise a plurality of fuel injectors for injecting a premixture of fuel and air.

3. The annular combustor as recited in claim 1 wherein the second plurality of tertiary fuel injectors comprise a plurality of fuel injectors for injecting a premixture of fuel and air.

4. The annular combustor as recited in claim 1 wherein the interaction of the combustion gases at the interface of the central primary combustion zone and the first tertiary combustion zone generates a generally clockwise flow of the combustion gases in the first tertiary combustion zone.

5. The annular combustor as recited in claim 1 wherein the interaction of the combustion gases at the interface of the central primary combustion zone and the second tertiary combustion zone generates a generally counterclockwise flow of the combustion gases in the second tertiary combustion zone.

6. An annular combustor for a gas turbine engine, comprising:

an inboard liner extending circumferentially and extending longitudinally fore to aft;

an outboard liner extending circumferentially and extending longitudinally fore to aft and circumscribing the inboard liner;

a bulkhead extending between a forward end of the inboard liner and a forward end of the outboard liner and in cooperation with the inboard liner and the outboard liner defining an annular combustion chamber; and the outboard liner including a forward section defining a radially outward projecting substantially rectangular stabilization chamber extending aftward from the bulkhead and circumferentially about and in open relationship to the annular combustion chamber;

the inboard liner including a forward section defining a radially inward projecting substantially rectangular stabilization chamber extending aftward from the bulkhead in open relationship to the annular combustion chamber;

a plurality of primary fuel injectors opening through the bulkhead admitting fuel directly into a central primary combustion zone of the annular combustion chamber, the plurality of the primary fuel injectors disposed at circumferentially spaced intervals in a ring radially intermediate the inboard liner and the outboard liner;

a plurality of secondary fuel injectors opening through the bulkhead admitting fuel directly into a secondary combustion zone substantially located in the stabilization chamber of the outboard liner, the plurality of secondary fuel injectors being independently controllable relative to the plurality of primary fuel injectors, disposed at circumferentially spaced intervals in a ring coaxially radially outboard of the plurality of primary fuel injectors and arranged in circumferential alignment with the plurality of primary fuel injectors;

a first plurality of tertiary fuel injectors opening through the bulkhead admitting fuel directly into a first tertiary combustion zone, the first plurality of tertiary fuel injectors being independently controllable relative to the plurality of primary fuel injectors and plurality of secondary fuel injectors, disposed at circumferentially spaced intervals in a ring coaxially radially outboard of the plurality of primary fuel injectors and coaxially radially inboard of the plurality of the secondary fuel injectors, and arranged in an alternating relationship with the plurality of primary fuel injectors and plurality of secondary fuel injectors, the first tertiary combustion zone located coaxially radially outboard of the central primary combustion zone and coaxially radially inboard of the secondary combustion zone; and a second plurality of tertiary fuel injectors opening through the bulkhead admitting fuel into a second tertiary combustion zone of the annular combustion chamber, the second plurality of tertiary fuel injectors being independently controllable relative to the plurality of primary fuel injectors, plurality of secondary fuel injectors and the first plurality of tertiary fuel injectors, disposed at circumferentially spaced intervals in a ring coaxially radially inboard of the primary fuel injectors and arranged in an alternating relationship with the plurality of primary fuel injectors and plurality of secondary fuel injectors, the second tertiary combustion zone located radially inward of the central primary combustion zone.

7. The annular combustor as recited in claim 6 wherein the first plurality of tertiary fuel injectors comprise a plurality of fuel injectors for injecting a premixture of fuel and air.

8. The annular combustor as recited in claim 6 wherein the second plurality of tertiary fuel injectors comprise a plurality of fuel injectors for injecting a premixture of fuel and air.

9. The annular combustor as recited in claim 6 wherein the interaction of the combustion gases at the interface of the central primary combustion zone and the first tertiary combustion zone generates a generally clockwise flow of the combustion gases in the first tertiary combustion zone.

10. The annular combustor recited as recited in claim 6 wherein the interaction of the combustion gases at the interface of the central primary combustion zone and the second tertiary combustion zone generates a generally counterclockwise flow of the combustion gases in the second tertiary combustion zone.

11. A method for operating a gas turbine engine over a power demand range having a low power demand, an intermediate power demand and a high power demand, the gas turbine engine having a combustor, the combustor having an inboard liner, an outboard liner circumscribing the inboard liner, and a bulkhead extending between a forward end of the inboard liner and a forward end of the outboard liner and in cooperation with the inboard liner and the outboard liner defining an annular combustion chamber, the outboard liner including a forward section defining a radially outward projecting substantially rectangular stabilization chamber extending aftward from the bulkhead and circumferentially about and in open relationship to the annular combustion chamber, the inboard liner including a forward section and an aft section, the forward section converges towards the outboard liner from fore to aft and the aft section converges towards the outboard liner from fore to aft more gradually than the forward section, the combustor further including a plurality of primary fuel injectors opening through the bulkhead admitting fuel directly into a central primary combustion zone of the annular combustion chamber, the plurality of the primary fuel injectors disposed at circumferentially spaced intervals in a ring radially intermediate the inboard liner and the outboard liner, the combustor further including a plurality of secondary fuel injectors opening through the bulkhead admitting fuel directly into a secondary combustion zone substantially located in the stabilization chamber of the outboard liner, the plurality of secondary fuel injectors being independently controllable relative to the plurality of primary fuel injectors, disposed at circumferentially spaced intervals in a ring coaxially radially outboard of the plurality of primary fuel injectors and arranged in circumferential alignment with the plurality of primary fuel injectors, and the combustor further including a first plurality of tertiary fuel injectors opening through the bulkhead admitting fuel directly into a first tertiary combustion zone, the first plurality of tertiary fuel injectors being independently controllable relative to the plurality of primary fuel injectors and plurality of secondary fuel injectors, disposed at circumferentially spaced intervals in a ring coaxially radially outboard of the plurality of primary fuel injectors and coaxially radially inboard of the plurality of secondary fuel injectors, and arranged in an alternating relationship with the plurality of primary fuel injectors and plurality of secondary fuel injectors, the first tertiary combustion zone located coaxially radially outboard of the central primary combustion zone and coaxially radially inboard of the secondary combustion zone, the method comprising the steps of:

injecting a primary fuel supply into the primary combustion zone during all power demands, the primary combustion zone intermediate the inboard liner and the outboard liner;

injecting a secondary fuel supply into a secondary combustion zone during all power demands, the secondary combustion zone substantially in the first stabilization chamber, the secondary fuel supply being independently controllable relative to the primary fuel supply; and injecting a first tertiary fuel supply into the first tertiary combustion zone during intermediate and high power demand, the first tertiary combustion zone coaxially radially outboard of the primary combustion zone and coaxially radially inboard of the secondary combustion zone, the first tertiary fuel supply independently controllable relative to the primary fuel supply and the secondary fuel supply; and injecting a second tertiary fuel supply into a second tertiary combustion zone during high power demand, the second tertiary zone radially inboard of the primary combustion zone, the second tertiary fuel supply independently controllable relative to the primary fuel supply, the secondary fuel supply and the first tertiary fuel supply.

12. The method as recited in claim 11 further comprising the steps of at low power demand:

combusting the primary fuel supply in a fuel-lean zone at an equivalence ratio of less than 1.0; and combusting the secondary fuel supply in the first stabilization chamber at an equivalence ratio of about 1.0.

* * * * *